US012349827B2

(12) United States Patent
Thorn

(10) Patent No.: US 12,349,827 B2
(45) Date of Patent: Jul. 8, 2025

(54) TRAVEL PILLOW

(71) Applicant: Oakthrift Corporation Ltd., Tolleshunt Knights (GB)

(72) Inventor: James John Thorn, Tolleshunt Knights (GB)

( * ) Notice: Subject to any disclaimer, the term of this patent is extended or adjusted under 35 U.S.C. 154(b) by 181 days.

(21) Appl. No.: 17/842,550

(22) Filed: Jun. 16, 2022

(65) Prior Publication Data

US 2023/0404303 A1 Dec. 21, 2023

(51) Int. Cl.
*A47G 9/10* (2006.01)

(52) U.S. Cl.
CPC ..... *A47G 9/1027* (2013.01); *A47G 9/1081* (2013.01)

(58) Field of Classification Search
CPC ..... A47G 9/1027; A47G 9/1081; A47G 2009/003; A47G 2009/1018; A47G 9/1045; A47G 9/10; A47C 7/383; A47C 16/00; A47C 20/02; A47C 27/082; A47C 7/38; A47C 7/386; A47C 27/081; A41D 2200/20; A41D 13/0512; A42B 1/048; A42B 1/203; A42B 1/006; A42B 1/046; A42B 1/045; A42B 1/0186; A42B 1/004; Y10S 2/03; F04B 33/00
USPC ..... 5/636, 639, 644, 244, 640; 2/202, 84, 2/171; D6/601, 604; D2/878, 866; 441/132, 88, 56
See application file for complete search history.

(56) References Cited

U.S. PATENT DOCUMENTS 10,123,638 B2 * 11/2018 Thorn ..... A47G 9/1027
11,033,129 B2 * 6/2021 Diaz ..... A47C 7/383
2008/0229498 A1 * 9/2008 Grosso ..... A47C 7/383 5/244
2015/0274044 A1 * 10/2015 Kreppein ..... A47C 16/00 5/636
2017/0265554 A1 * 9/2017 Woodle ..... A42B 1/048
2018/0125271 A1 * 5/2018 Blanc ..... A47C 7/383

FOREIGN PATENT DOCUMENTS

KR 101792058 B1 * 11/2017 ..... F04B 33/00
WO WO-2015022446 A1 * 2/2015 ..... A41D 13/0512

OTHER PUBLICATIONS

ELEOPTION—NPL—Amazon, hereinafter 'ELEOPTION', Date First Available Jun. 28, 2017, https://a.co/d/go7uGEJ (Year: 2017).*
Roamwild—Amazon—NPL, hereinafter 'Roamwild, Date First Available May 25, 2016, https://a.co/d/4nx8dtS (Year: 2016).*
Researchgate, Discussion of Discorectangular, Oct. 2019, https://www.researchgate.net/figure/Example-of-a-discorectangle_fig1_336510978 (Year: 2019).*

* cited by examiner

*Primary Examiner* — Madison Emanski
(74) *Attorney, Agent, or Firm* — Donn K. Harms

(57) ABSTRACT

A travel pillow comprises a U-shaped neck support having a rear portion and first and second side portions extending therefrom and first and second inflatable pouches each comprising at least one air valve and a manual pump operable to inflate its pouch. Each side portion of the neck support comprises an outer side wall and an inner side wall defining a recess configured to house a lower portion of a pouch such that an upper portion of the pouch extends upwardly from the side portion. The outer side wall of each side portion comprises a gap in which a first side of a pump of a pouch is located such that the pump is accessible to a user wearing the support.

11 Claims, 4 Drawing Sheets

TRAVEL PILLOW

The present invention relates to a travel pillow.

Travel pillows are routinely used by travellers to aid rest whilst travelling

Typically travel pillows are often formed of memory foam, are U-shaped in configuration, and are adapted to be retained around the neck of a user such that the user may rest their head on either side of the pillow.

In order to aid retention of a pillow around the neck of a user some existing travel pillows comprise an attachment adapted to attach together the free ends of the U-shaped pillow.

The present invention seeks to improve upon the prior art.

According to the present invention there is provided a travel pillow comprising:

- a U-shaped neck support having a rear portion and first and second side portions extending therefrom;
- first and second inflatable pouches each comprising at least one air valve and a manual pump operable to inflate its pouch; wherein
- each side portion of the neck support comprises an outer side wall and an inner side wall defining a recess configured to house a lower portion of a pouch such that an upper portion of the pouch extends upwardly from the side portion;
- the outer side wall of each side portion comprises a gap in which a first side of a pump of a pouch is located such that the pump is accessible to a user wearing the support.

Beneficially providing a neck support having a gap to locate a pump of an inflatable pouch allows a user readily locate and access the pump to inflate the pouch by pressing on the first side of the pump whilst the travel pillow is being worn.

In some embodiments the outer side wall of each side portion comprises a substantially U-shaped gap.

In some embodiments the inner side wall of each side portion comprises a corresponding gap in which a second side of the pump of a pouch is located.

In some embodiments the inner side wall of each side portion comprises a substantially U-shaped gap.

By providing gaps in the inner side wall of each side portion the second side of a pump acts as part of the neck support when the pouches are deflated, and may be rested upon by a user. When the pouches are inflated part of the inflated pouch bulges from the gap so as to provide comfortable support for the neck of a user.

In some embodiments each pouch comprises a single air inlet/outlet valve.

In some embodiments the support comprises a hood in which the U-shaped neck support and inflatable pouches are housed.

In some embodiments the valves extend through side walls of the hood.

In some embodiments the hood comprises a frontal strap to connect together sides of the hood.

In some embodiments each pouch is substantially discorectangular.

In some embodiments each pouch comprises a substantially central inflatable region and a peripheral inflatable ring.

In some embodiments the central inflatable region comprises the pump and at least one air valve.

In some embodiments each recess is configured to house a lower portion of a peripheral inflatable ring of a pouch.

In order that the present invention may be more fully understood a specific embodiment will now be described by way of example with reference to the accompanying schematic drawings, of which:

A travel pillow 1 comprises a U-shaped neck support 2 and first and second inflatable pouches 13*a*, 13*b* and a hood 4.

U-shaped neck support 2 is formed of memory foam.

U-shaped neck support 2 comprises a rear portion 2*c*, a first side portion 2*a* and a second side portion 2*b*. First and second side portions 2*a*, 2*b* extend from rear portion 2*c*.

Each of side portions 2*a*, 2*b* comprises an inner wall 3*a*, 3*b*, an outer wall 4*a*, 4*b* and an upper surface 5*a*,5*b*.

Formed in each of side portions 2*a*, 2*b* between inner walls 3*a*, 3*b* and outer walls 4*a* 4*b*, and open to upper surfaces 5*a*, 5*b* are recesses 6*a*, 6*b*.

Recesses 6*a*, 6*b* are located between free ends of side portions 2*a*, 2*b* and rear portion 2*c* of U-shaped neck support 2.

Outer walls 4*a*, 4*b* also comprise substantially U-shaped gaps 7*a*, 7*b* located around the centre of recesses 6*a*, 6*b*. U-shaped gaps 7*a*, 7*b* are open to upper surfaces 5*a*, 5*b*.

Inner walls 8*a*, 8*b* also comprise U-shaped gaps 8*a*, 8*b* of the same size and shape as gaps 7*a*, 7*b*. Gaps 7*a*, 7*b* are aligned with each other, as are gaps 8*a*, 8*b*. In other embodiments an inner wall might not comprise U-shaped gaps 8*a*, 8*b* in inner walls of a U-shaped neck support.

Figure 5:
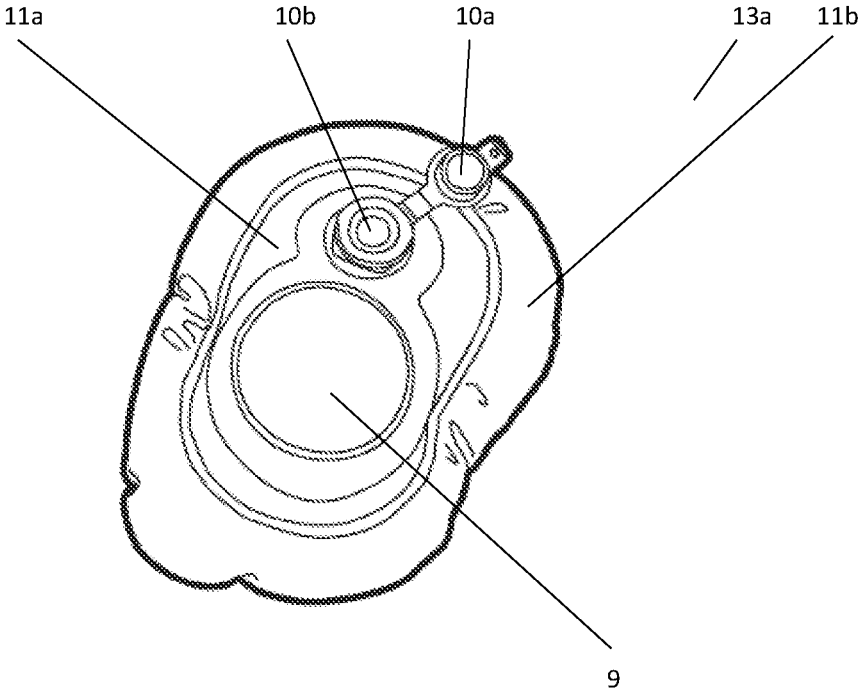
FIG. 5 is a perspective view of an inflatable pouch of FIG. 2 with its valve open.
Figure 6:
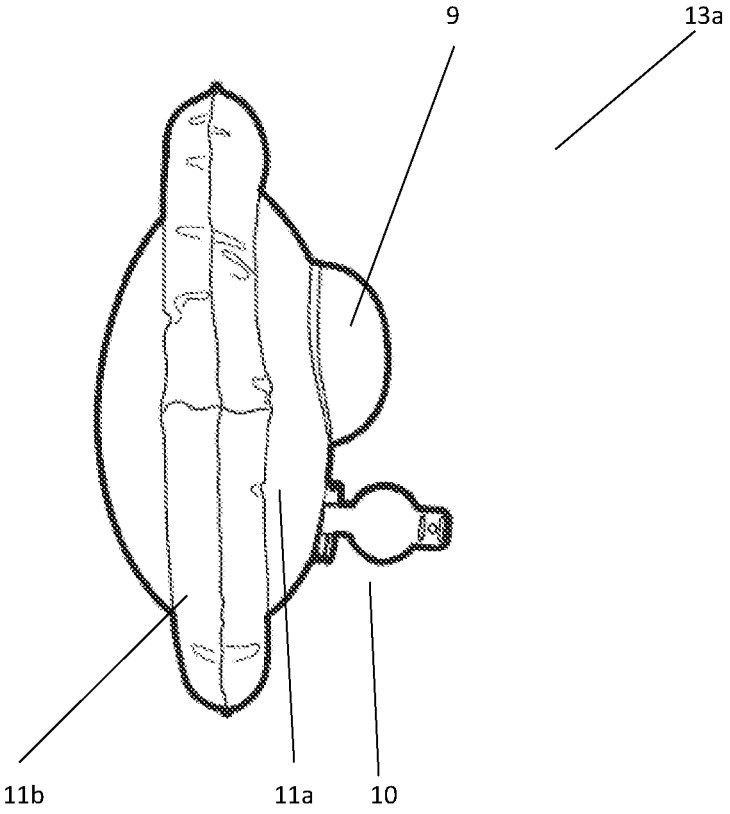
FIG. 6 is a side view of the inflatable pouch of FIG. 5 with its valve open.
Figure 7:
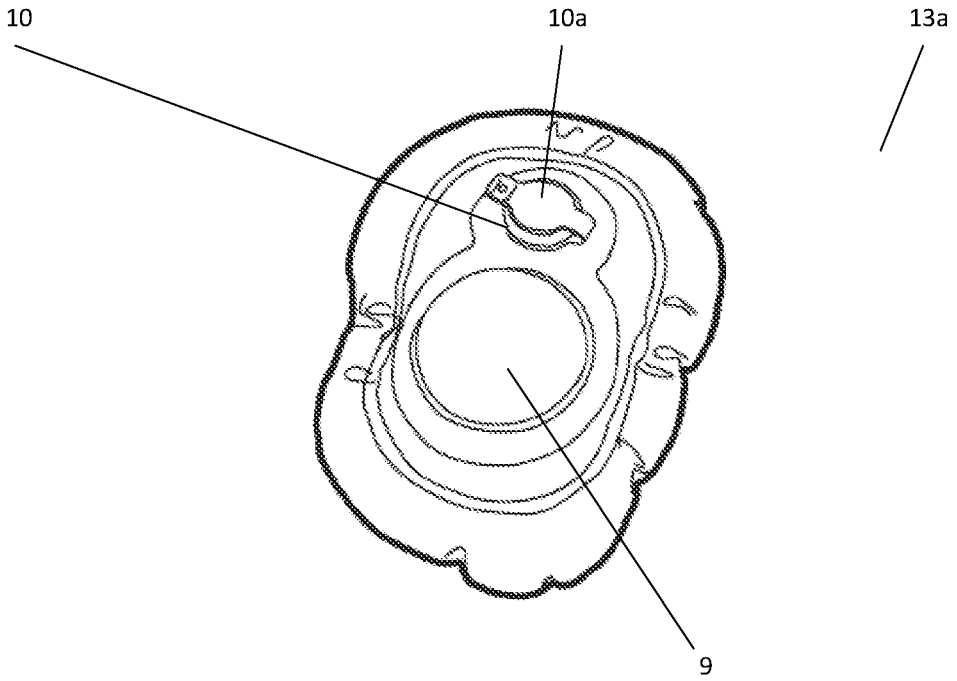
FIG. 7 is a perspective view of an inflatable pouch of FIG. 5 with its valve closed.

Recesses 6*a*, 6*b* are each of a size and shape to house a lower portion of an inflatable pouch of the type illustrated in FIGS. 5 to 7. Travel pillow 1 comprises two inflatable pouches 13*a*, 13*b* with one pouch being housed within each side portion 2*a*, 2*b*.

Pouches 13*a*, 13*b* are identical in size and shape so for expedience only one pouch is illustrated in FIGS. 5 to 7 and is described below.

Pouch 3*a* comprises a substantially spheroidal central inflatable region 11*a* and a peripheral inflatable ring 11*b* that defines the discorectangular shape of pouch 13*a*.

In central inflatable region 11*a* is located a substantially spherical pump 9 and an inlet/outlet valve 10.

Inlet/outlet valve 10 is of a type where to inflate pouch 13*a* valve 10 must be open. Manually pressing on pump 9 draws air into inflatable regions 11*a* and 11*b*. Once inflated valve 10 may be closed using cap 10*a*.

To deflate pouch 13*a* a user removes cap 10*a* and presses on a central portion 10*b* of valve 10 such that air is released from valve 10.

Figure 1:
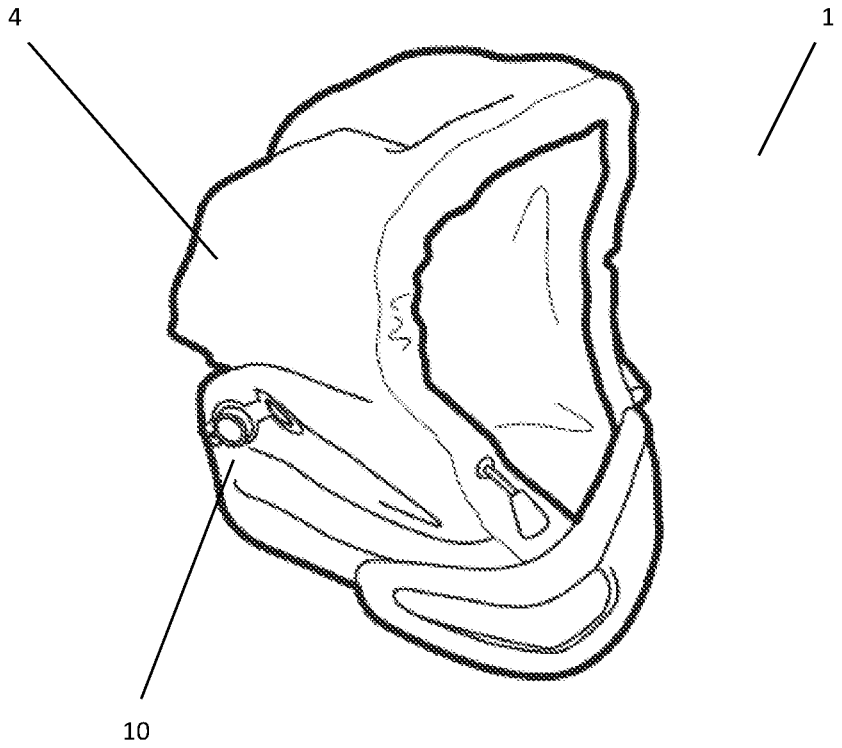
FIG. 1 is a perspective view of a head and neck support made in accordance with the present invention.
Figure 2:
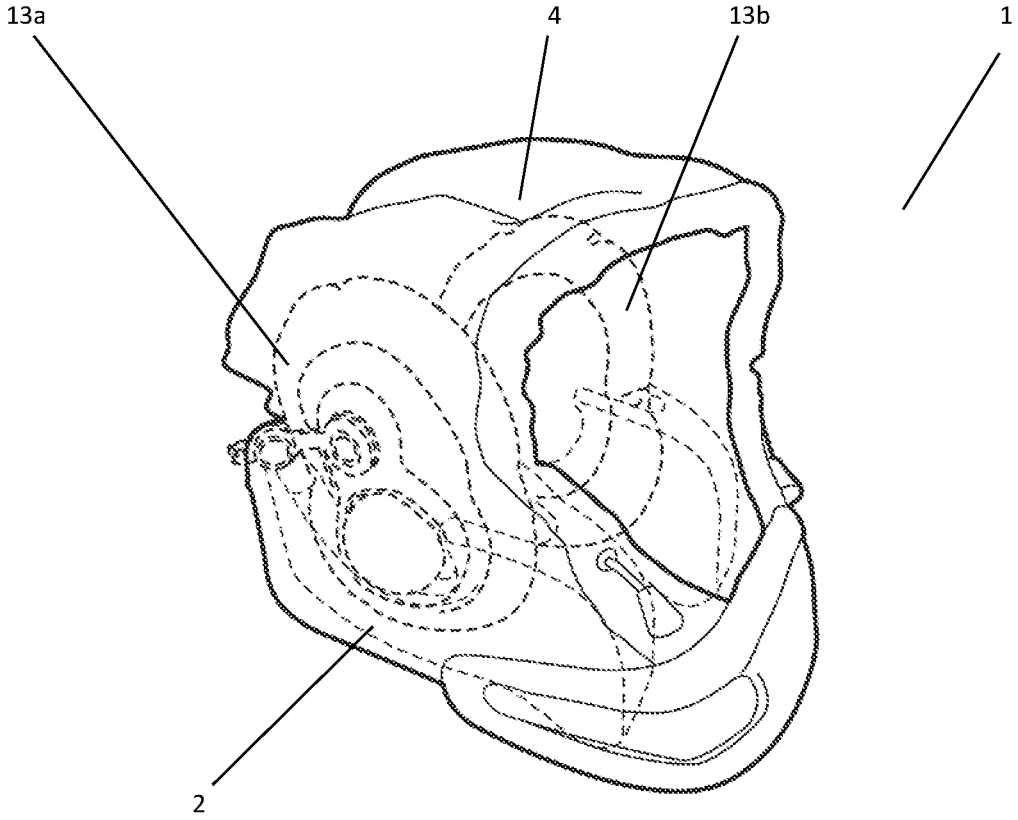
FIG. 2 is a view illustrating the position of a U-shaped member and inflatable pouches inside the support of FIG. 1.
Figure 3:
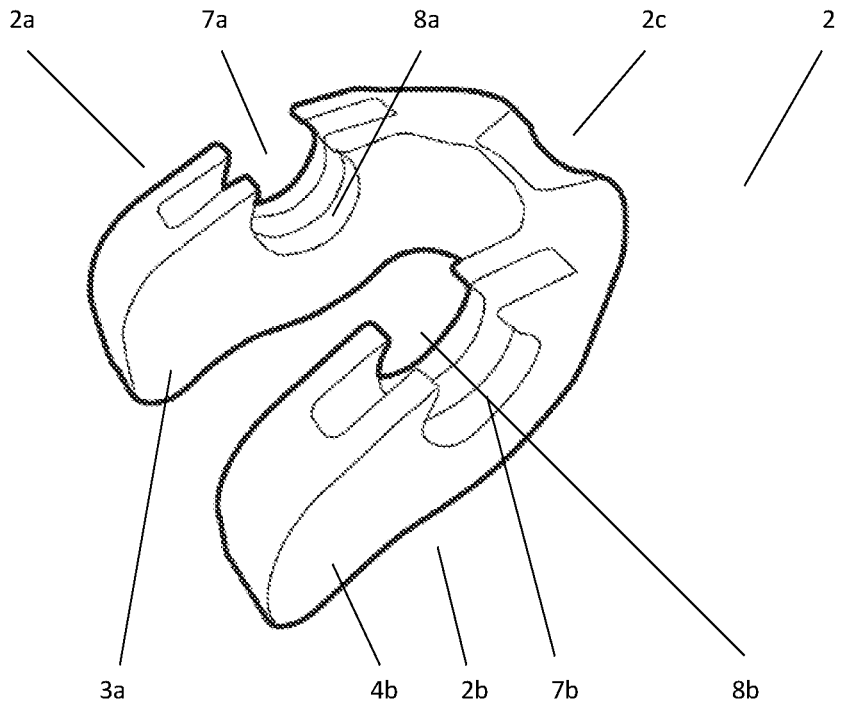
FIG. 3 is a perspective view of the U-shaped member of FIG. 2.
Figure 4:
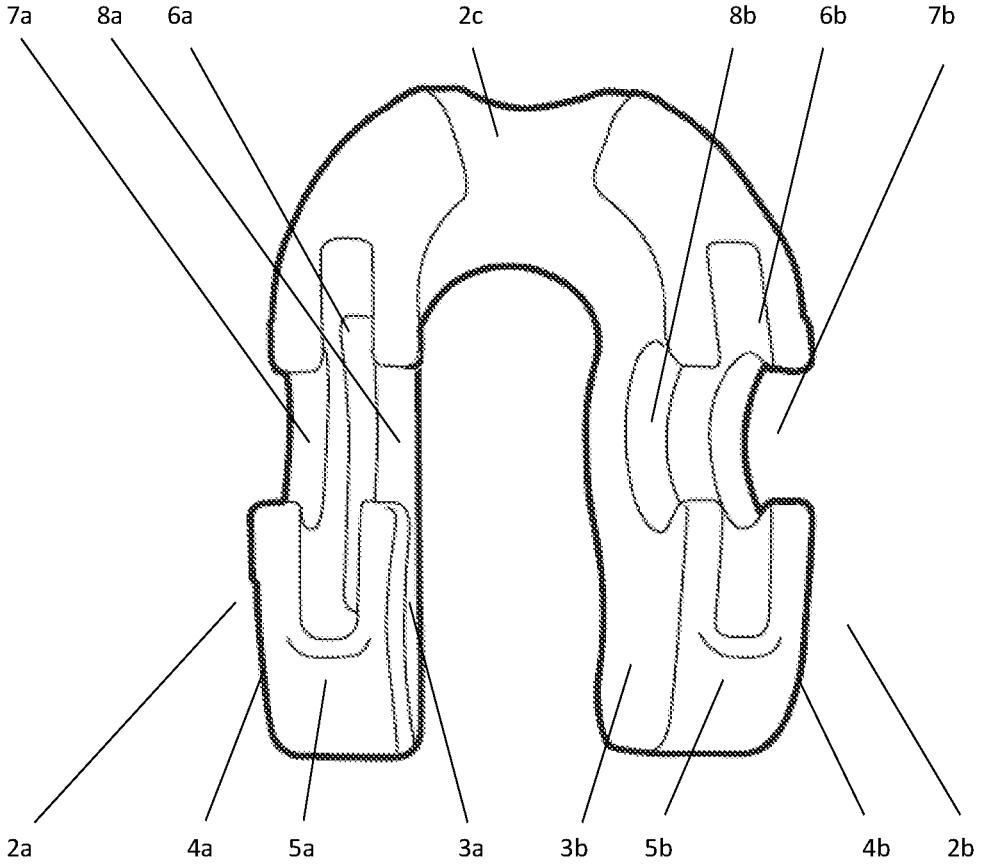
FIG. 4 is a plan view of the U-shaped member of FIG. 2.
Figure 8:
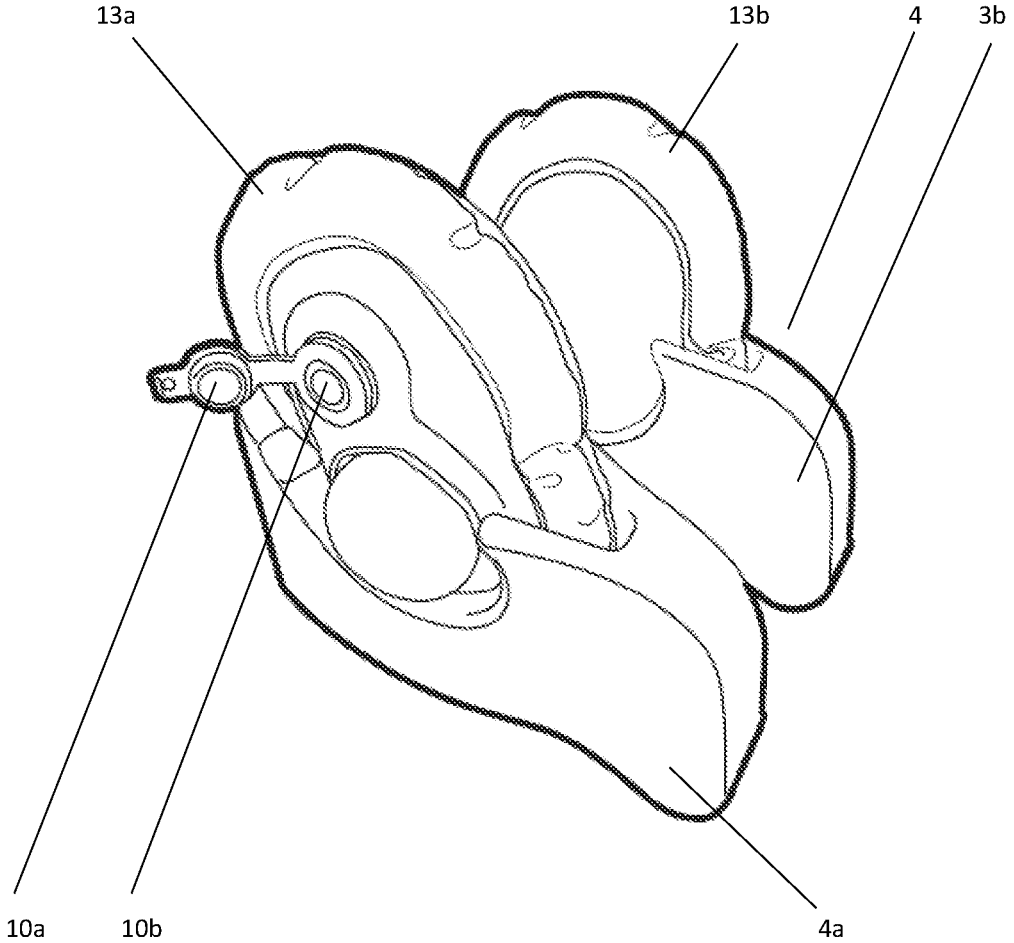
FIG. 8 is a perspective view of the U-shaped member and inflatable pouches inside the support of FIG. 1.

As illustrated in FIGS. 2 and 8, when travel pillow is assembled pouches 13*a*, 13*b* are positioned such that lower portions of their peripheral inflatable rings 11*b* are located within recesses 6*a*, 6*b*.

Pumps 9 are located within U-shaped gaps 7*a*, 7*b* and upper portions of pouches 13*a*, 13*b* extend upwardly from upper surfaces 5*a*, 5*b* of first and second side portions 2*a*, 2*b* of U-shaped neck support 2.

Thus pumps 9 are located such that they are in line with recesses 6*a*, 6*b* and first sides of pumps 9 partially fill gaps 7*a*, 7*b* of outer walls 4*a*, 4*b* of first and second side portions 2*a*, 2*b*. Similarly, second sides of pumps 9 partially fill gaps 8*a*, 8*b* of inner walls 3*a*, 3*b* of U-shaped neck support 2.

The neck-support and pouch assembly as illustrated in FIG. 8 is all housed within the lining of hood 4, which has apertures at either side through which valves 10 extend in order to be accessible to a user.

A user wearing travel pillow 1 may readily locate and access pumps 9 as they are held in position roughly at the middle of each side portion 2*a*, 2*b* of U-shaped neck support 2.

When inflated pouches 3*a*, 3*b* may have a user's head rested thereon.

Hood 4 comprises a frontal strap 12 that bears a portion of hook or loop fastener and is operable to attach to a corresponding portion of hook or loop fastener so as to connect together sides of the hood and tension U-shaped neck support 2 around a user's neck.

In this specification an apparatus/method/product "comprising" certain features is intended to be interpreted as meaning that it includes those features, but that it does not exclude the presence of other features.

Many variations are possible without departing from the scope of the present invention as defined in the appended claims.

The invention claimed is:

1. A travel pillow comprising:

a U-shaped neck support having a rear portion and first and second side portions extending therefrom;

first and second inflatable pouches each comprising at least one air valve and a manual pump operable to inflate each of said inflatable pouches;

each of said inflatable pouches comprises a substantially central inflatable region and a peripheral inflatable ring; wherein each side portion of the U-shaped neck support comprises an outer side wall and an inner side wall, each side portion further defining a recess configured to house a lower portion of each of said inflatable pouches such that an upper portion of each of said inflatable pouches extends upwardly from the side portion;

the outer side wall of each side portion comprises a gap in which a first side of the manual pump of each of said inflatable pouches is located such that the manual pump is accessible to a user wearing the U-shaped neck support.

2. The travel pillow of claim 1 wherein the gap of the outer side wall of each side portion is substantially U-shaped.

3. The travel pillow of claim 1 wherein the inner side wall of each side portion comprises a corresponding gap in which a second side of the manual pump of each of said inflatable pouches is located.

4. The travel pillow of claim 3 wherein the corresponding gap of the inner side wall of each side portion is substantially U-shaped.

5. The travel pillow of claim 1 wherein each inflatable pouch comprises a single air inlet/outlet valve.

6. The travel pillow of claim 5 wherein the U-shaped neck support comprises a hood in which the U-shaped neck support and inflatable pouches are housed.

7. The travel pillow of claim 6 wherein the single air inlet/outlet valves of each inflatable pouch extend through the outer and inner side walls of the hood.

8. The travel pillow of claim 6 wherein the hood comprises a frontal strap to connect together sides of the hood.

9. The travel pillow of claim 1 wherein each inflatable pouch is substantially discorectangular.

10. The travel pillow of claim 1 wherein the substantially central inflatable region comprises the manual pump and the at least one air valve.

11. The travel pillow of claim 1 wherein each recess is configured to house a lower portion of the peripheral inflatable ring of the first and second inflatable pouches.

* * * * *